United States Patent [19]

Wexler et al.

[11] Patent Number: 4,953,326

[45] Date of Patent: Sep. 4, 1990

[54] DRIVE-UP TELLER STATION

[75] Inventors: Stuart K. Wexler, Riverwoods; John E. Jones, Winnetka; Paul A. Jones, Glenview, all of Ill.

[73] Assignee: Glenview State Bank, Glenview, Ill.

[21] Appl. No.: 324,383

[22] Filed: Mar. 16, 1989

[51] Int. Cl.[5] ..... E04H 3/04

[52] U.S. Cl. ..... 52/33; 186/37

[58] Field of Search ..... 52/33, 174; 49/49; 404/6; 186/37, 53

[56] References Cited

U.S. PATENT DOCUMENTS

| | | | |
|---|---|---|---|
| 2,405,294 | 8/1946 | Delucchi | 52/33 X |
| 2,636,424 | 12/1949 | Lebert . | |
| 2,636,456 | 3/1950 | Cooper . | |
| 2,638,636 | 1/1951 | Pool . | |
| 3,436,879 | 4/1969 | Duke . | |
| 3,810,705 | 5/1974 | Warriner . | |

*Primary Examiner*—David A. Scherbel
*Assistant Examiner*—Creighton Smith
*Attorney, Agent, or Firm*—Arnold, White & Durkee

[57] ABSTRACT

A customer service station is provided where an employee looks in the same direction for both walk-up customers and drive-up customers, so that the employee can make visual contact with each type of customer. The customer service station includes a counter behind which an area for employees is located. A drive-up window is located in front of the counter, and an area for walk-in customers is located between the counter and the drive-up window. A drive-up area is located in front of the counter and on a side of the drive-up window opposite from the walk-in area. Therefore, an employee who is standing behind the counter can look beyond customers in the walk-in area to view customers in the drive-up area also.

29 Claims, 2 Drawing Sheets

DRIVE-UP TELLER STATION

BACKGROUND OF THE INVENTION

1. Field of the Invention

This invention relates generally to building architecture, and more particularly to a drive-up customer service station, such as a teller station, which is capable of accommodating both walk-in and drive-up customers.

2. Description of Related Art

In businesses which deal with both walk-in and drive-up customers, it is often desirable for employees to make visual contact with customers. The visual contact allows the employees to monitor the actions of the customers in order to provide prompt, efficient service and, more importantly, to give the customers a sense of personal treatment. Since many people prefer drive-up service to walk-in service, many service-oriented businesses now provide drive-up stations. It is not uncommon for a person to visit a bank, a dry cleaner, and a restaurant without ever leaving his automobile.

Unfortunately, the architectural layout of the buildings in which these service-oriented businesses operate is often inefficient. Many older buildings, which were initially designed to accommodate only walk-in customers, have been converted to accommodate drive-up customers also. In most instances, this conversion is accomplished by merely providing a drive-up window which is monitored by at least one additional employee. Surprisingly, designs of many newer buildings, which are specifically intended to accommodate both walk-in customers and drive-up customers, conform to the designs of the older conversions.

Many banks, for instance, provide both walk-in and drive-up service so that their customers can conveniently make transactions. Of all service-oriented businesses, it is perhaps most important for financial institutions to give personal service to their customers, since they are dealing with large amounts of money in many cases. Therefore, bank buildings typically have a large customer service area for tellers which includes a row of individual teller stations facing the interior of the building to accommodate walk-in customers, and one or more outwardly facing teller stations to accommodate drive-up customers. This arrangement requires the tellers to move back and forth between opposite sides of their work area to service both walk-in and drive-up customers. This is not only inefficient but also leads to confusion and errors because at least certain of the tellers are required to keep track of currency at two different locations, one of which is convenient for servicing walk-up customers and the other of which is convenient for servicing drive-up customers. As an alternative, a bank may hire additional tellers so that some tellers service only walk-in customers, while other tellers service only drive-up customers. This is an inherently inefficient approach, however, because there will inevitably be more non-productive time when the various tellers are idle.

Some service-oriented businesses, such as banks, are capable of providing service to more than one drive-up customer at a time. Most drive-up teller stations include a drive-up window through which a bank employee monitors a plurality of parallel drive-up lanes. The cars are positioned adjacent one another in their respective drive-up lanes, such that the drive-up teller must look over the cars in the near lanes to see the cars in the far lanes. It is entirely possible that a large vehicle, such as a van, whose driver chooses to make his transaction in one of the near lanes, will prevent the drive-up teller from seeing cars in the outside lanes.

The present invention is directed to overcoming one or more of the problems as set forth above.

SUMMARY OF THE INVENTION

It is the primary object of the present invention to provide a drive-up teller station which enables a teller to service both walk-in and drive-up customers from a single location, thereby reducing confusion and errors on the part of the teller.

It is an important object of the present invention to provide a drive-up teller station arrangement which requires fewer employees than previous teller station arrangements.

It is another object of the present invention to provide a drive-up teller station which enables the teller to maintain visual contact with each drive-up customer, as well as walk-in customers.

It is yet another object of the present invention to provide a drive-up teller station in which the teller looks in the same direction for both walk-up customers and drive-up customers.

It is still another object of the present invention to provide a drive-up teller station which promotes efficient use of a bank's employees.

In accordance with the present invention, the foregoing objectives are realized by providing a drive-up teller station arrangement which enables a teller to look in the same direction for both walk-up customers and drive-up customers, so that a teller can service each type of customer from the same location. A customer service station is provided which includes a counter behind which an area for employees is located. A drive-up window is located in front of the counter, and an area for walk-in customers is located between the counter and the drive-up window. A drive-up customer area is located in front of the counter, beyond the drive-up window and the walk-in customer area. Therefore, an employee who is standing behind the counter can look beyond customers in the walk-in area to view customers in the drive-up area also.

Since the height of a car is generally less than a height of a person, the position of a drive-up customer's automobile is optimized so that a drive-up customer can more easily be seen by an employee. Thus, in accordance with one aspect of the invention, a customer service station is provided, as described above, where the area for drive-up customers is elevated with respect to the area for walk-in customers. Since the drive-up customer area is elevated, it is easier for an employee behind the counter to make visual contact with a drive-up customer when customers are in the walk-in area.

It is often desirable for an employee to make visual contact with more than one drive-up customer at a time. Therefore, in accordance with another aspect of the invention, the automobiles of drive-up customers are offset from one another so that the employee has a direct line of vision to each drive-up customer. This is preferably achieved by providing the drive-up customer area with a plurality of arcuate drive-up lanes which are positioned concentrically at progressively greater radial distances from the counter. Each of the drive-up lanes includes a transaction station which is laterally offset from the transaction stations in the other lanes so that an employee behind the counter is able to make visual contact with at least two automobiles positioned adjacent respective transaction stations.

BRIEF DESCRIPTION OF THE DRAWINGS

Other objects, and advantages of the invention will become apparent upon reading the following detailed description and upon reference to the accompanying drawings, in which.

Figure 1:
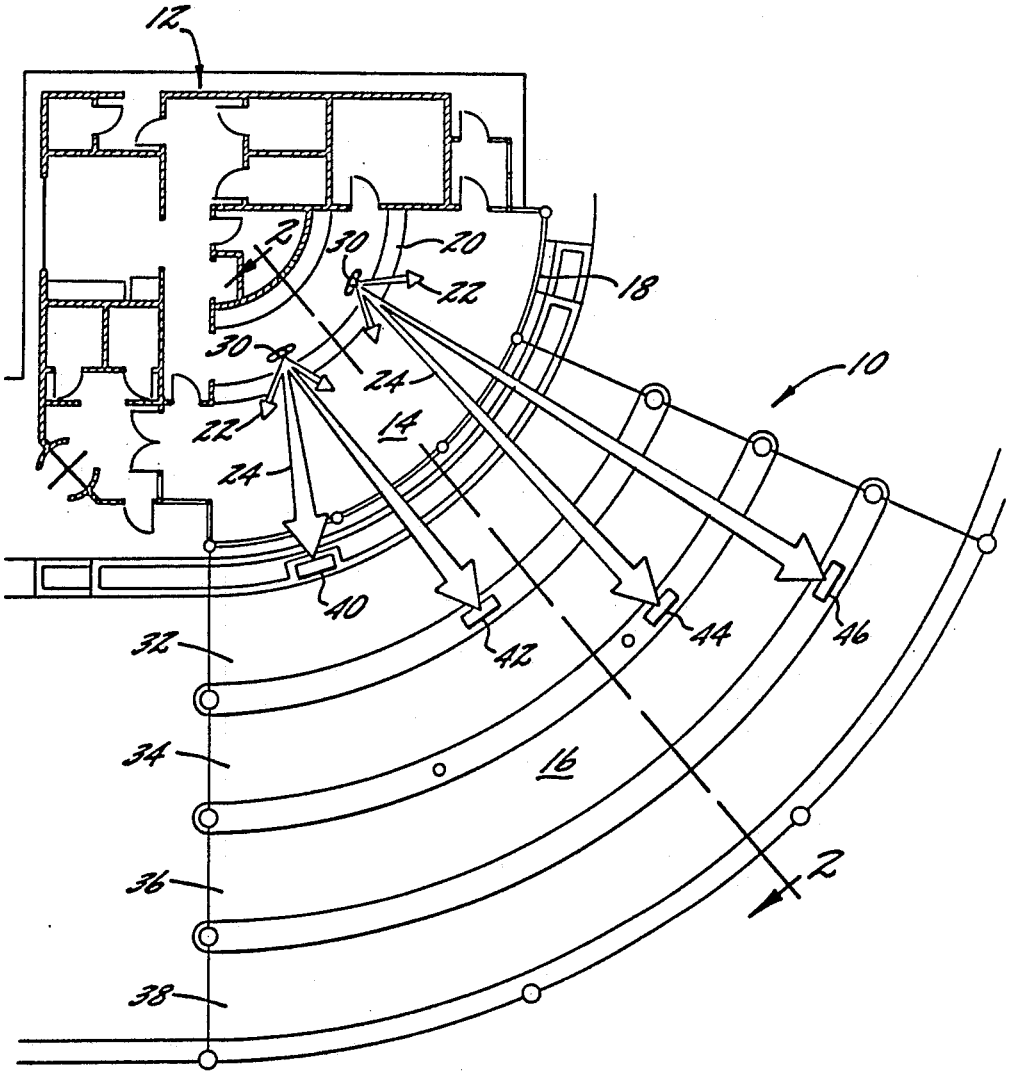
FIG. 1 is a top plan view of a customer service station embodying the present invention.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Figure 2:
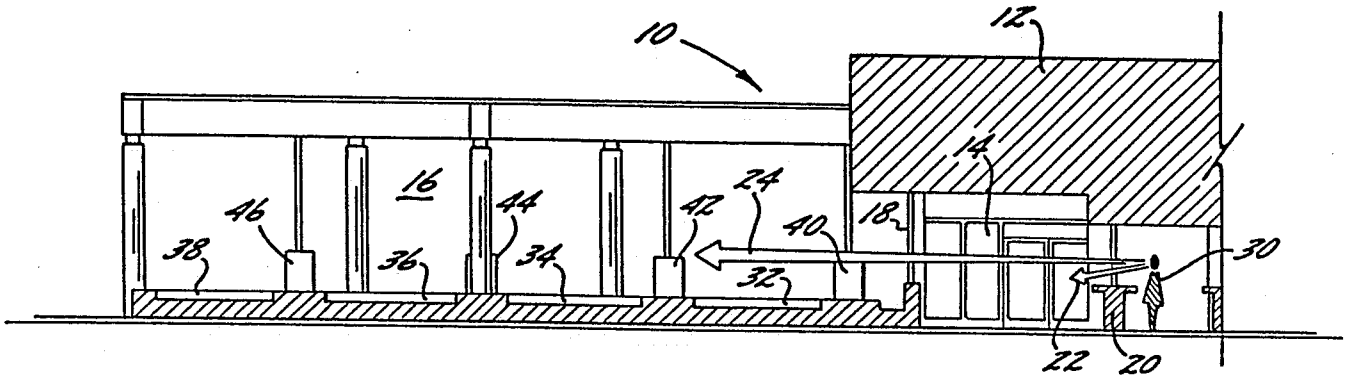
FIG. 2 is a sectional view taken generally along line 2—2 in FIG. 1.

Turning now to the drawings and referring initially to FIGS. 1 and 2, a customer service station 10 includes a building 12 having an area 14 for walk-in customers located inside the building 12. Located adjacent the building 12 is an outdoor area 16 for drive-up customers. A drive-up window 18 separates the walk-in area 14 from the drive-up area 16. Employees standing behind a counter 20 are able to look out generally in the direction of the sets of arrows 22,24 to make visual contact with customers in both the walk-in area 14 and with customers in the drive-up area 16.

As can be seen in FIG. 2, the drive-up area 16 is at a higher elevation than the walk-in area 14, to enhance the tellers' ability to see the customers in the drive-up area 16. When customers are in the walk-in area 14, employees behind the counter 20 may have to look over the customers in the walk-in area 14 to see a customer in the drive-up area 16. Since automobiles are typically shorter than people, the elevated drive-up area 16 makes it easier for employees behind the counter 20 to see automobiles in the drive-up area 16. The arrows 22,24 in FIG. 2 generally depict the lines of sight of employees 30 who are standing behind the counter 20.

Preferably, a plurality of drive-up lanes 32,34,36,38 are located in the drive-up area 16, so that a plurality of drive-up customers may be serviced at the same time. Each drive-up lane 32,34,36,38 includes a respective transaction station 40,42,44,46. Drive-up customers position their vehicles adjacent a transaction station 40,42,44,46 in order to carry out a transaction with employees in the building 12. Preferably, each transaction station 40,42,44,46 includes a speaker and a microphone (not shown) so that the drive-up customers and the employees within the building 12 may verbally communicate. Moreover, each transaction station 40,42,44,46 preferably includes means for passing materials back and forth between an employee and the drive-up customer. For instance, a pneumatically operated mechanism connects the employee service station to the transaction stations so that materials within a tube may be passed back and forth between the employee and the drive-up customer. The transaction stations 40,42,44,46 can also include an automatic transaction means such as an electronically controlled automatic teller device.

To further enhance the employees' ability to see customers in the drive-up lanes 32,34,36,38, the transaction stations 40,42,44,46 are laterally offset from one another. With this configuration, an employee 30 is able to make visual contact with each vehicle positioned adjacent a respective transaction station. Transaction stations 40,42,44,46 which are progressively further from the counter 20 are located progressively further in the direction of movement of the customer vehicles, so that no vehicle blocks the line of sight between any other vehicle and its respective teller. As shown in FIG. 1, employees standing behind the counter 20 view the drive-up customers generally along the arrows 24.

To improve the overall efficiency of the customer service station, the counter 20 is arcuately shaped or at least includes a arcuately shaped portion. The drive-up window 18 and the drive-up lanes 32,34,36,38 have corresponding arcuately shaped portions which are substantially concentric with the arcuately-shaped portion of the counter 20. This allows an employee 30, who is standing behind the counter 20, to look out in radial directions to view customers in both the walk-in area 14 and the drive-up area 16. Therefore, the employee 30 can turn or pivot slightly to view different customers adjacent respective transaction stations 40,42,44,46.

Figure 3:
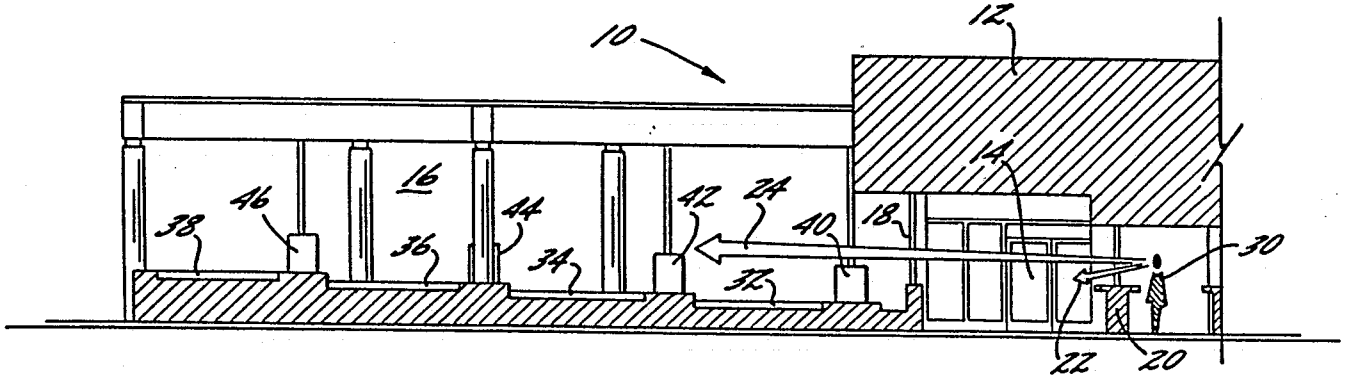
FIG.3 is an alternate sectional view taken generally along line 2—2 in FIG. 1 and showing an alternative arrangement.

FIG. 3 illustrates an alternative embodiment in which the multiple drive-up lanes 32,34,36,38 are progressively elevated relative to each other as well as the teller area. The visibility of customers in the drive-up area 16 is further enhanced by progressively elevating each drive-up lane 32,34,36,38 such that the lane nearest to the drive-up window 18 is the lowest, and the lane furthest from the drive-up window 18 is the highest. While this configuration provides a small improvement in visibility where the transaction stations 40,42,44,46 are offset from one another, it provides a greater improvement in visibility where the transaction stations 40,42,44,46 lie along the same line of vision of the employee 30. Since customers in progressively more distant drive-up lanes are at progressively higher elevations, the employee 30 can look over vehicles in nearer lanes to see customers in more distant lanes.

We claim:

1. A drive-up customer service station, comprising:

a service counter and an area for employees located on one side of the service counter;

a drive-up window located on the opposite side of said service counter;

a walk-in customer area located between said service counter and said drive-up window; and a drive-up customer area located on the opposite side of said drive-up window from said walk-in customer area.

2. The drive-up customer service station, as set forth in claim 1, wherein said service counter is parallel to said drive-up window.

3. A drive-up customer service station, comprising:

a service counter and an area for employees located on one side of the service counter;

a drive-up window located on the opposite side of said service counter;

a walk-in customer area located between said service counter and said drive-up window; and a drive-up customer area located on the opposite side of said drive-up window from said walk-in customer area, said drive-up customer area being at a higher elevation than said walk-in customer area.

4. The drive-up customer service station, as set forth in claim 1, wherein said drive-up customer area includes a plurality of drive-up lanes.

5. The drive-up customer service station, as set forth in claim 4, wherein said plurality of drive-up lanes are parallel to one another.

6. A drive-up customer service station, comprising:

a service counter and an area for employees located on one side of the service counter;

a drive-up window located on the opposite side of said service counter;

a walk-in customer area located between said service counter and said drive-up window; and a drive-up customer area located on the opposite side of said drive-up window from said walk-in customer area, said drive-up customer area including a plurality of drive-up lanes which are progressively elevated such that the lane nearest to said drive-up window is the lowest, and the lane farthest from said drive-up window is the highest.

7. A drive-up customer service station, comprising:

a service counter and an area for employees located on one side of the service counter;

a drive-up window located on the opposite side of said service counter;

a walk-in customer area located between said service counter and said drive-up window; and a drive-up customer area located on the opposite side of said drive-up window from said walk-in customer ara, said counter including an arcuately shaped portion; and said drive-up window including an arcuately shaped portion which is substantially concentric with the arcuately shaped portion of said counter.

8. The drive-up customer service station, as set forth in claim 7, wherein:

said drive-up customer area includes at least one arcuately shaped drive-up lane which is substantially concentric with said arcuately shaped portion of said drive-up window, and wherein said drive-up lane includes a transaction station.

9.

10. The drive-up customer service station, as set forth in claim 9 wherein said transaction stations are circumferentially offset from one another, so that an employee behind the counter is able to make visual contact with each vehicle positioned adjacent a respective transaction station.

11. The drive-up customer service station, as set forth in claim 9 wherein said arcuately shaped drive-up lanes are located at progressively increasing radial distances from said counter.

12. A drive-up customer service station comprising:

a service counter and an area for employees located on one side of the service counter;

a drive-up window located on the opposite side of said service counter;

a walk-in customer area located between said service counter and said drive-up window; and a drive-up customer area located on the opposite side of said drive-up window from said walk-in customer area and elevated with respect to said walk-in customer area, whereby an employee behind the counter is able to make visual contact with vehicles in the drive-up area when customers are in said walk-in area.

13. The drive-up customer service station, as set forth in claim 12, wherein said service counter is parallel to said drive-up window.

14. The drive-up customer service station, as set forth in claim 12, wherein said drive-up customer area includes a plurality of drive-up lanes.

15. The drive-up customer service station, as set forth in claim 14, wherein said plurality of drive-up lanes are parallel to one another.

16. A drive-up customer service station comprising:

a service counter and an area for employees located on one side of the service counter;

a drive-up window located on the opposite side of said service counter;

a walk-in customer area located between asid service counter and said drive-up window; and a drive-up customer area located on the opposite side of said drive-up window from said walk-in customer area and elevated with respect to said walk-in customer area, whereby an employee behind the counter is able to make visual contact with vehicles in the drive-up area when customers are in said walk-in area and wherein, said drive-up lanes are progressively elevated such that the lane nearest to said drive-up window is the lowest, and the lane farthest from said drive-up window is the highest.

17. A drive-up customer service station comprising:

a service counter and an area for employees located on one side of the service counter;

a drive-up window located on the opposite side of said service counter;

a walk-in customer area located between said service counter and said drive-up window; and a drive-up customer area located on the opposite side of said drive-up window from said walk-in customer area and elevated with respect to said walk-in customer area, whereby an employee behind the counter is able to make visual contact with vehicles in the drive-up area when customers are in said walk-in area, said counter including an arcuately shaped portion; and said drive-up window including an arcuately shaped portion which is substantially concentric with the arcuately shaped portion of said counter.

18. The drive-up customer service station, as set forth in claim 17, wherein said drive-up customer area includes at least one arcuately shaped drive-up lane which is substantially concentric with said arcuately shaped portion of said drive-up window, and wherein said drive-up lane includes a transaction station.

19. A drive-up customer service station comprising:

a service counter and an area for employees located on one side of the service counter;

a drive-up window located on the opposite side of said service counter;

a walk-in customer area located between said service counter and said drive-up window; and a drive-up customer area located on the opposite side of said drive-up window from said walk-in customer area and elevated with respect to said walk-in customer area, whereby an employee behind the counter is able to make visual contact with vehicles in the drive-up area when customers are in said walk-in area, said drive-up customer area including a plurlaity of arcuately shaped drive-up lanes which are parallel to each other and each drive-up lane including a transaction station.

20. The drive-up customer service station, as set forth in claim 19 wherein said transaction stations are circumferentially offset from one another, so that an employee behind the counter is able to make visual contact with each vehicle positioned adjacent a respective transaction station.

21. The drive-up customer service station, as set forth in claim 19 wherein said plurality of arcuately-shaped drive-up lanes are positioned parallel to one another at progressively increasing radial distances from said counter.

22. A drive-up customer service station, comprising:

an arcuate service counter and an area for employees located on one side of said counter;

an arcuate drive-up window located on the opposite side of said counter;

a walk-in customer area located between said counter and said drive-up window;

a drive-up customer area located on the opposite side of said drive-up window from said walk-in customer area, said drive-up customer area including a plurality of arcuate drive-up lanes, each of which includes a transaction station.

23. The drive-up customer service station, as set forth in claim 22, wherein said plurality of arcuate drive-up lanes are positioned concentrically at progressively greater radial distances from said counter.

24. The drive-up customer service station, as set forth in claim 22, wherein said transaction stations are laterally offset from each other so that an employee behind said counter is able to make visual contact with at least two vehicles positioned adjacent respective transaction stations

25. The drive-up customer service station, as set forth in claim 23, wherein said transaction stations are laterally offset so that an employee behind said counter is able to make visual contact with at least two vehicles positioned adjacent respective transaction stations.

26. The drive-up customer service station, as set forth in claim 25, wherein vehicles move through said lanes in the same direction.

27. The drive-up customer service station, as set forth in claim 26, wherein said transaction stations which are associated with lanes progressively farther from said counter are located progressively farther in the direction of movement of said automobiles, so that no vehicle blocks the line of sight between any other vehicle and its respective teller.

28. The drive-up customer service station, as set forth in claim 22, wherein said drive-up customer area is at a higher elevation than said walk-in customer area.

29. The drive-up customer service station, as set forth in claim 22, wherein said drive-up lanes are progressively elevated such that the lane nearest to said drive-up window is the lowest, and the lane furthest from said drive-up window is the highest.

* * * * *